US005568780A

United States Patent [19]

Menzin et al.

[11] Patent Number: 5,568,780

[45] Date of Patent: Oct. 29, 1996

[54] COMBINING CONVEYOR SYSTEM WITH COMBINING FIXTURE

[75] Inventors: Marvin Menzin, Lexington; Donald E. Burt, Danvers; Henry R. Cofek, Groton, all of Mass.

[73] Assignee: Design Technology Corporation, Billerica, Mass.

[21] Appl. No.: 183,499

[22] Filed: Jan. 19, 1994

[51] Int. Cl.[6] ..... D05B 39/00

[52] U.S. Cl. ..... 112/470.18; 112/470.36; 112/475.03; 112/63

[58] Field of Search ..... 112/304, 102, 112/103, 104, 117, 118, 119, 63, 2.1, 470.06, 470.09, 470.12, 470.18, 475.03; 271/105, 175, 211, 167; 414/903, 906; 269/21; 365/97

[56] References Cited

U.S. PATENT DOCUMENTS

| | | | |
|---|---|---|---|
| 2,609,768 | 9/1952 | Cash et al. | 112/2.1 |
| 2,918,884 | 12/1959 | Kalning et al. | 112/2.1 |
| 4,155,317 | 5/1979 | Enomoto | 112/2.1 |
| 4,558,653 | 12/1985 | Horton et al. | 112/121.15 X |
| 4,763,586 | 8/1988 | Takenoya et al. | 112/121.12 X |
| 4,982,675 | 1/1991 | Taguchi et al. | 112/121.12 |
| 4,996,931 | 3/1991 | Mall | 112/121.15 X |
| 5,016,549 | 5/1991 | Sadlack et al. | 112/121.15 X |
| 5,040,473 | 8/1991 | Zesch et al. | 112/117 |
| 5,182,998 | 2/1993 | Iwase | 112/117 |
| 5,218,915 | 6/1993 | Iwasaki et al. | 112/121.15 X |
| 5,237,943 | 8/1993 | Klein et al. | 112/121.15 X |
| 5,272,994 | 12/1993 | Scholl et al. | 112/121.15 |

*Primary Examiner*—Ismael Izaguirre
*Attorney, Agent, or Firm*—Rhodes Coats & Bennett, L.L.P.

[57] ABSTRACT

A combining conveyor system for combining a first fabric piece and a second fabric piece to form a combined fabric piece, such as a men's brief. The apparatus includes an unique combining fixture. The fixture includes: a base; fabric clamping device for receiving and securing the first fabric piece, the second fabric piece, and the combined fabric piece; and a support attached to the base and supporting the fabric clamping device. A conveyor transports the combining fixture to at least one work station for operating on the first and second fabric pieces. A transfer station removes the combining fixture from said conveyor when the operations are completed.

102 Claims, 6 Drawing Sheets

COMBINING CONVEYOR SYSTEM WITH COMBINING FIXTURE

BACKGROUND OF THE INVENTION

1. Field of the Invention

The present invention relates generally to a combining conveyor system for assembling fabric pieces, and more particularly, to a combining conveyor system for fabric having a unique combining fixture.

2. Description of the Prior Art

The manufacture of textile clothing articles such as briefs, tee-shirts and outer garments has resisted automation. This is due largely to the difficulty in accurately positioning so called "soft" materials. For example, the knitted material commonly used in briefs and tee-shirts may wrinkle, stick to one another and stretch significantly when handled.

One technique which has been somewhat successful has been the introduction of fiber optic edge detectors. Such detectors, when attached to a sewing machine and guide means can allow some automation of common sewing operations such as binding an edge of a precut fabric piece. However, such operations still require the use of a skilled operator to feed the fabric piece to the sewing machine and usually carry out only one sewing operation at a time.

Thus, there remains a need for a combining conveyor system for assembling fabric pieces for manufacturing fabric assemblies for a men's brief or the like which can be carried out completely automatically without the need for a skilled operator.

SUMMARY OF THE INVENTION

The present invention is directed to a combining conveyor system which combines a first fabric piece and a second fabric piece to form a combined fabric piece, such as a men's brief. The apparatus includes a unique combining fixture. The fixture includes: a base; fabric clamping means for receiving and securing the first fabric piece, the second fabric piece, and the combined fabric piece; and a support attached to the base and supporting the fabric clamping means. A conveyor transports the combining fixture to at least one work station having means for operating on the first and second fabric pieces. A transfer station removes the combining fixture from the conveyor when the operations are completed.

Accordingly, one aspect of the present invention is to provide a combining conveyor system for combining a first fabric piece and a second fabric piece to form a combined fabric piece. The apparatus includes: (a) a combining fixture having means for holding the first fabric piece and the second fabric piece; (b) a conveyor for transporting the combining fixture; and (c) at least one work station having means for operating on the first and second fabric pieces.

Another aspect of the present invention is to provide a combining fixture for combining a first fabric piece and a second fabric piece to form a combined fabric piece. The fixture includes: (a) a base; (b) fabric clamping means for receiving and securing the first fabric piece, the second fabric piece, and the combined fabric piece; and (c) a support attached to the base and supporting the fabric clamping means.

Still another aspect of the present invention is to provide a combining conveyor system for combining a first fabric piece and a second fabric piece to form a combined fabric piece. The apparatus includes: (a) a combining fixture, the fixture including: (i) a base; (ii) fabric clamping means for receiving and securing the first fabric piece, the second fabric piece, and the combined fabric piece; and (iii) a support attached to the base and supporting the fabric clamping means; (b) a conveyor for transporting the combining fixture; (c) at least one work station having means for operating on the first and second fabric pieces; and (d) a transfer station for removing the combining fixture from the conveyor.

These and other aspects of the present invention will become apparent to those skilled in the art after a reading of the following description of the preferred embodiment when considered with the drawings.

DESCRIPTION OF THE PREFERRED EMBODIMENTS

Figure 1:
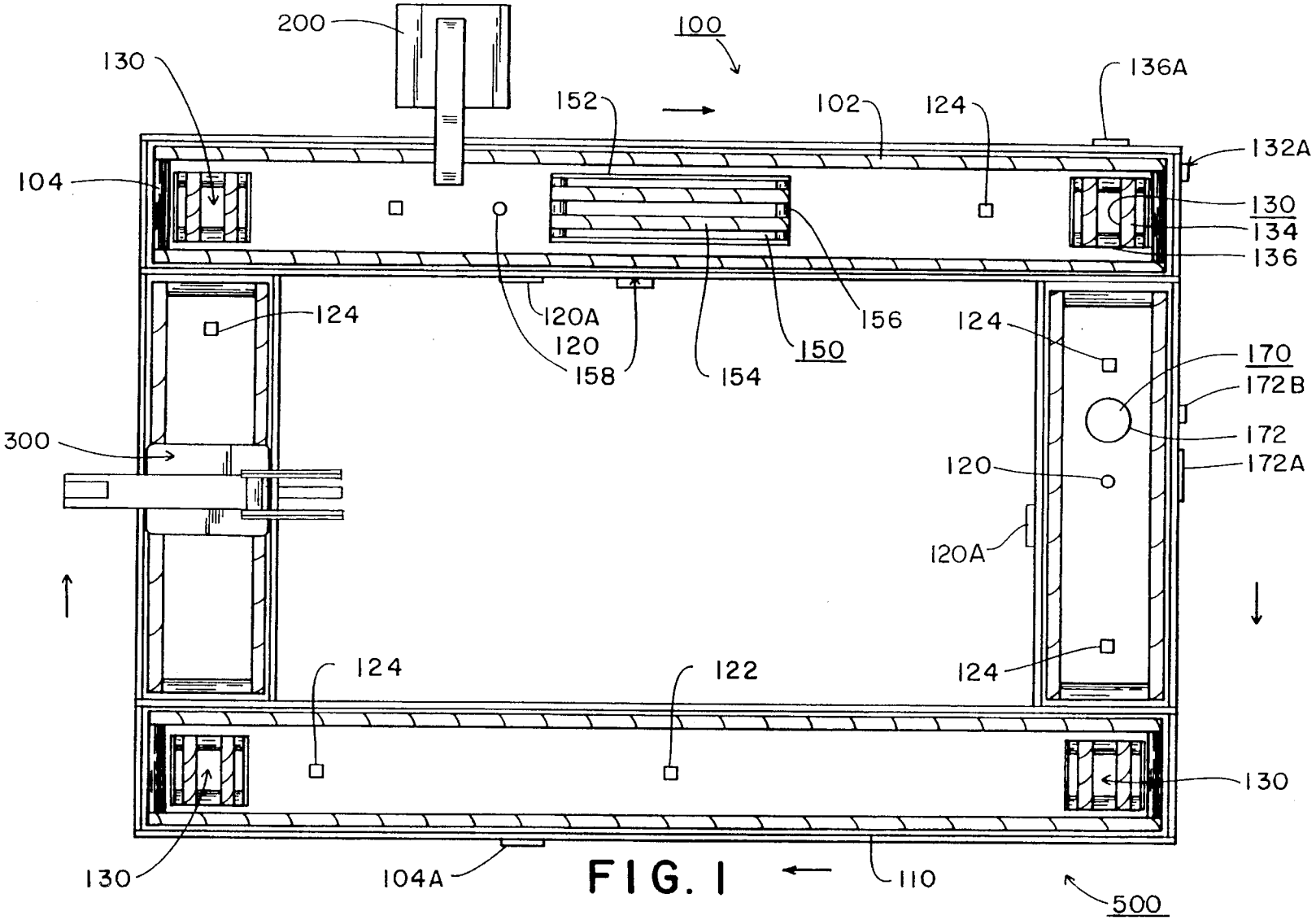
FIG. 1 is a plan view of a combining conveyor system constructed according to the present invention.
Figure 2:
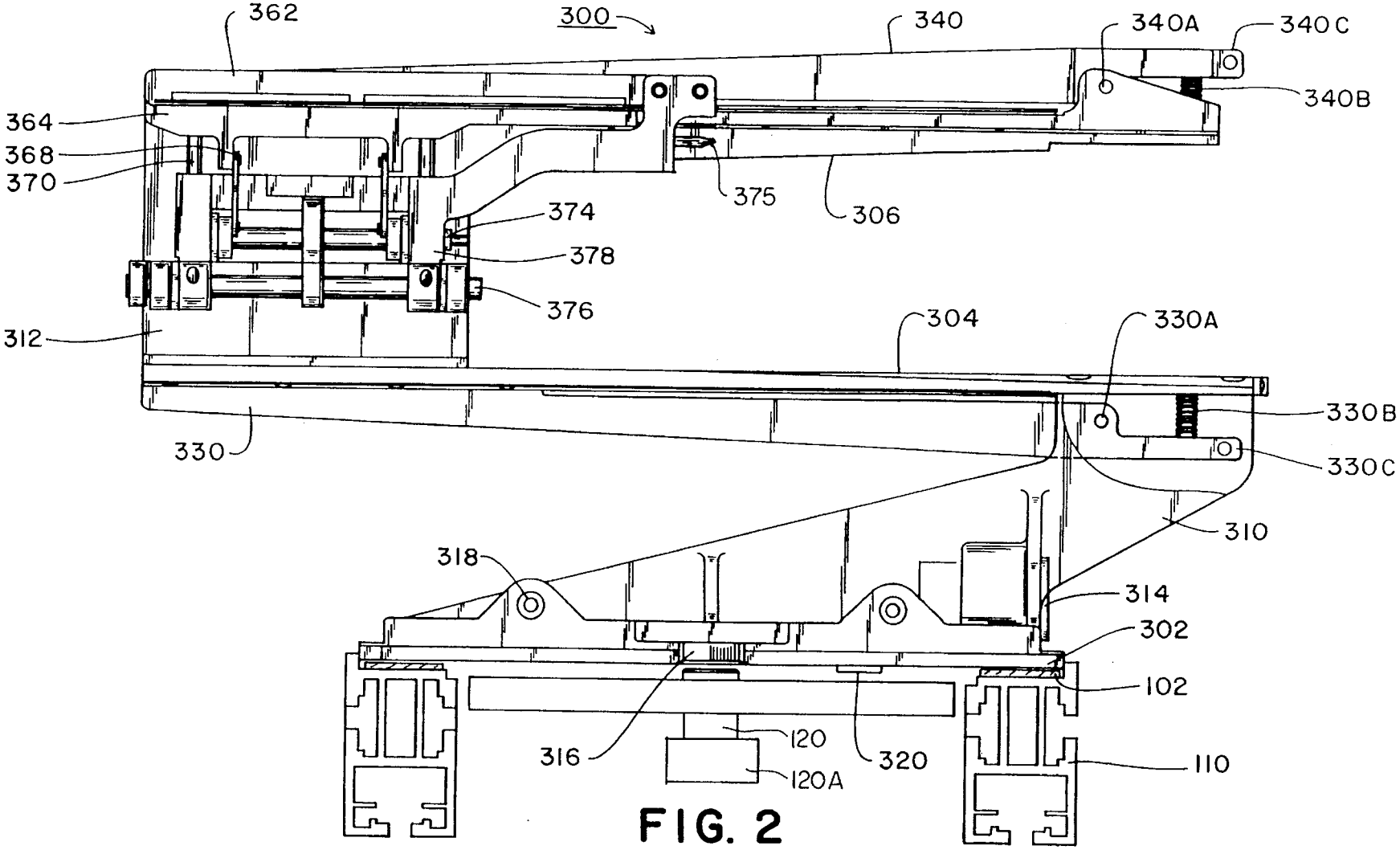
FIG. 2 is a partially fragmented side elevational view of a combining fixture mounted on a conveyor, which forms a part of the present invention.
Figure 3:
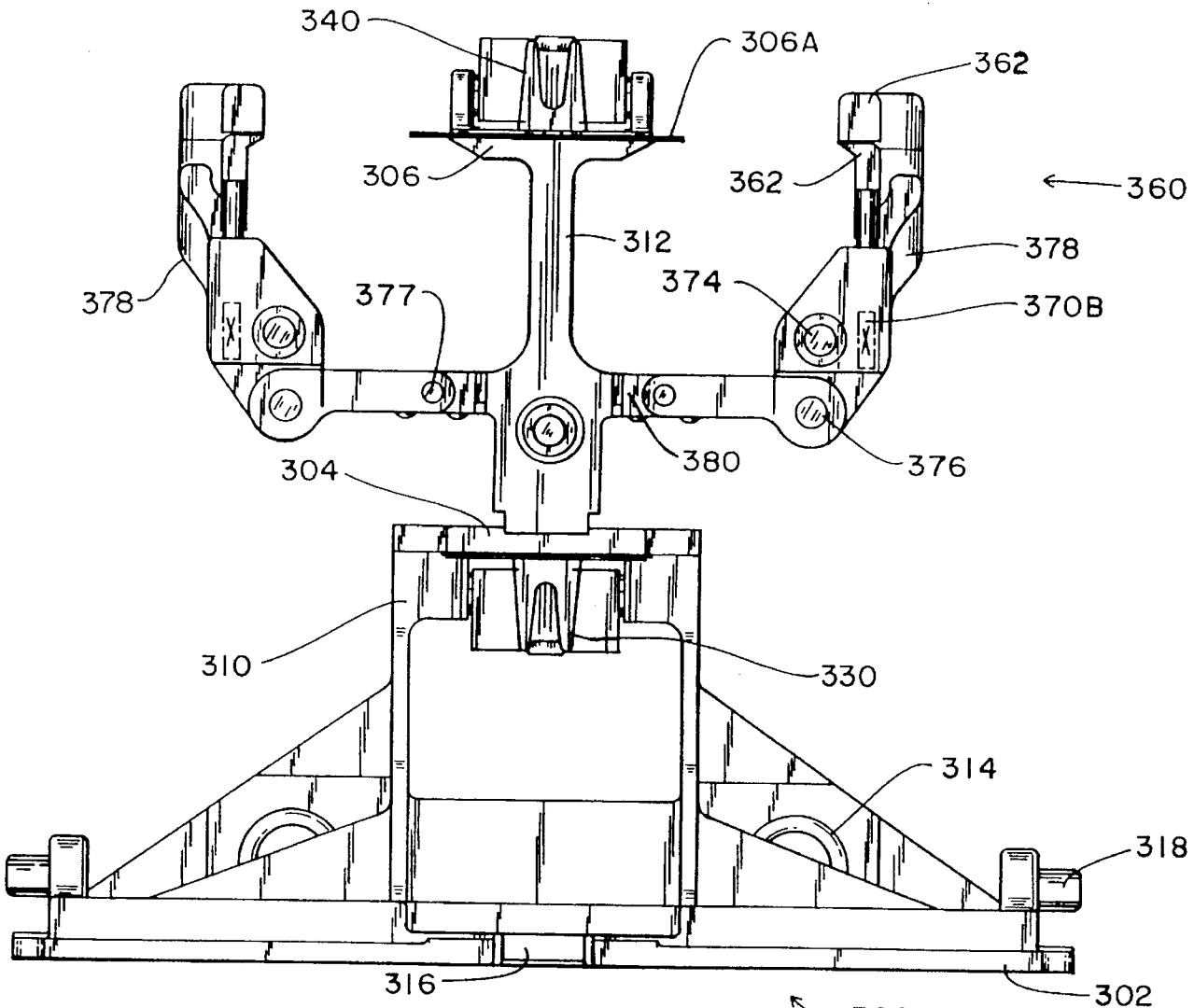
FIG. 3 is an end view of the combining fixture forming a part of the present invention.
Figure 4:
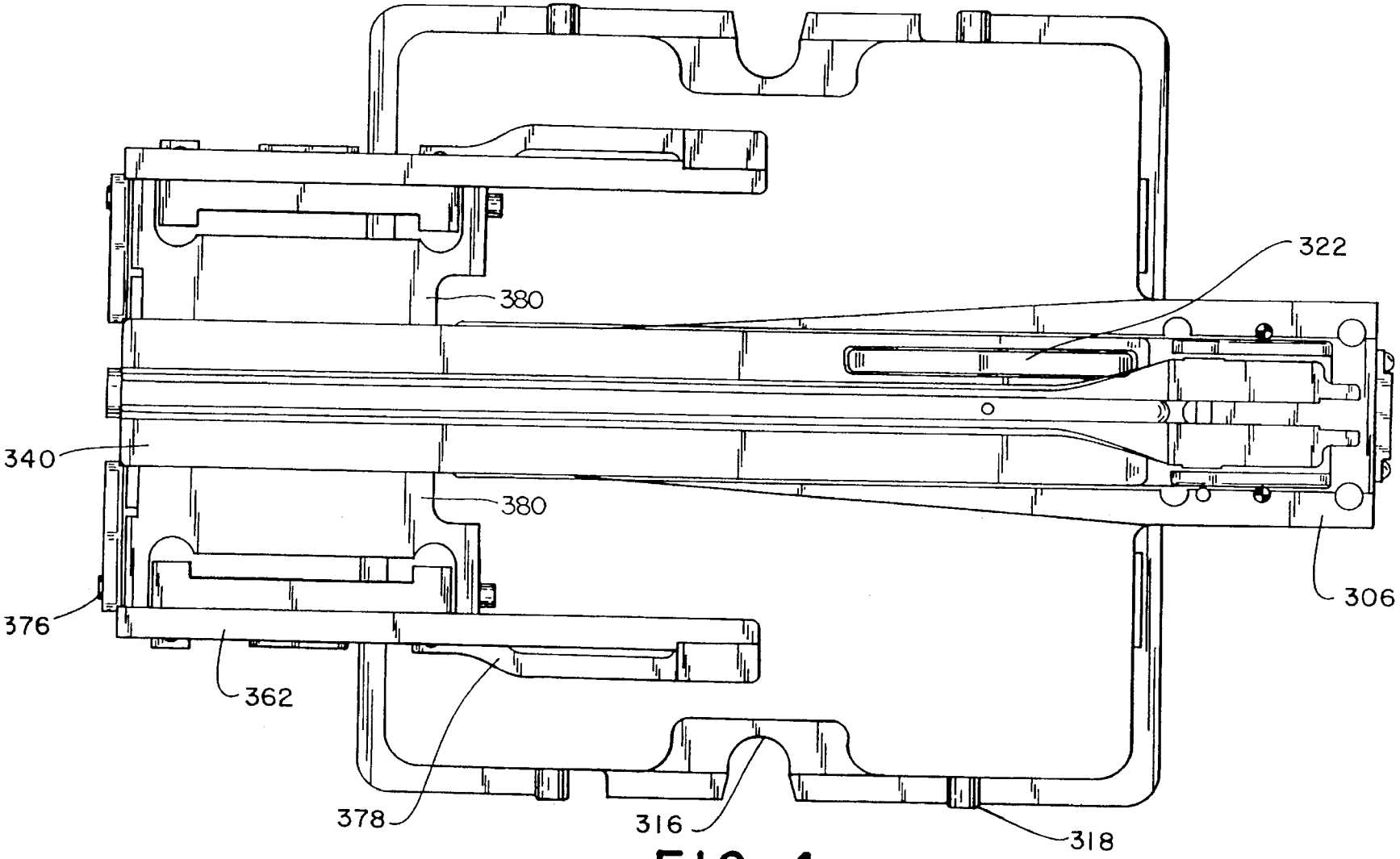
FIG. 4 is a partial top view of the combining fixture forming a part of the present invention.

In the following description, like reference characters designate like or corresponding parts throughout the several views. Also in the following description, it is to be understood that such terms as "forward", "rearward", "left", "Right", "upwardly", "downwardly", and the like are words of convenience and are not to be construed as limiting terms.

The present invention provides for automatic handling of fabric pieces and fabrication of garments from the same. While the following description of the preferred embodiment only discloses the operation of combining two fabric pieces, it will be understood that a multiplicity and variety of operations could be performed on the fabric pieces and the resulting garment using the system of the present invention. In describing the preferred embodiment, the process for manufacturing men's briefs underwear will be discussed. However, many similar garment applications will be obvious to those skilled in the art.

As best seen in FIG. 1, the apparatus of the present invention includes two basic sub-systems: a conveyor generally denoted by the numeral 100 and a combining fixture generally denoted by the numeral 300. Also forming a part of the invention is sewing machine 200. While only this single work station is shown, the system of the present invention can easily be designed to accommodate many work stations.

Basic operation of the present invention is as follows. Fixture 300 rides along conveyor 100. Work stations such as sewing machine 200 are located along the path of conveyor 100. As a garment mounted on fixture 300 passes by a work station, it is operated upon. Several features are provided to facilitate the flow of the fixture and the accuracy and efficiency of the operations including lift systems 130, rotators 170, stops 120, secondary conveyors 150, and sensor means 122 and 124. It is particularly noteworthy that a plurality of fixtures can be used at once, and therefore a plurality of garments can be fabricated simultaneously.

Conveyor 100 has frame 110. Mounted on frame 110 are primary belts 102 which ride on a fluorocarbon plastic surface and are driven by primary drive means 104A. These drive means may be servo-controlled or conventional motors, for example, depending on the degree of control needed for the associated operations. Fixture 300, which will be discussed more fully later, has base 302 adapted to ride on conveyor 100 and is guided by frame 110. In operation, fixture 300 travels in a clockwise direction. Lift systems 130 are provided to allow fixture 300 to pass around the corners of conveyor 100 without interference with frame 110.

Lift systems 130 have lift belts 134 which travel on lift rollers 136 and are driven by lift motors 136A. Lift systems 130 also have lift supports which support the aforementioned lift system components and are operatively connected to pneumatic cylinders 132A. When fixture 300 is positioned over a lift system 130, the cylinder is actuated such that the lift support raises and meets the base of fixture 300. Driven lift belts 134 engage fixture 300 and push or pull (depending on whether the lift system is located at the entrance or at the exit of the corner) fixture 300 over frame 110 and onto the adjacent primary belts 102. Position sensors 124 sense the presence of fixture 300 and can thereby provide associated software with the data necessary to determine when fixture 300 is in position to raise the lift support.

Rotator 170 operates much like lift system 130. Position sensor 124 signals the position of fixture 300. Rotator support 172 is raised by a pneumatic cylinder 172B and rotated by a pneumatic actuator 172A. Depending on the desired position of fixture 300 for the next operation, fixture 300 may be rotated 90° or 180°.

When multiple fixtures are used or where speed sensitive operations are implemented, it will be advantageous to control the speed of each fixture. Stops 120 are provided to stop a fixture when desired. Stops 120 are actuated by a pneumatic cylinder 120A in the preferred embodiment and engage stop locator 316 formed in base 302 of fixture 300. Stops 120 can then be retracted to allow fixture 300 to resume travel. Secondary conveyors 150 are provided to either speed up or slow down fixtures on various portions of conveyor 100. Secondary belts 154 are driven by drive means 158 and ride on rollers 156 which are in turn mounted on secondary lift 152. A fixture traveling over a secondary lift is raised off the primary belts and as a result travels at the speed of the secondary belts. This is helpful to ensure a steady and appropriate speed at any given work station, such as a sewing machine, during operation.

Turning now to combining fixture 300, the same is shown in detail in FIGS. 2–4 and 6. Fixture 300 has base 302. Attached to base 302 is lower support 310 which supports lower platform 304 on one end. At the opposite end of the lower platform 304, upper support 312 is attached to and supported by the same. Upper support 312 supports upper platform 306 and gripping arms 360.

Bumpers 318 are mounted on base 302 to protect fixture 300 in case of collisions with other fixtures. An identification badge 320 is affixed to the bottom of base 302 to provide information about the fixture and its associated garment to a scanning device. Identification badge 320 may be a bar code or an electrically encoded tab, for example. Sensor means 122 located on conveyor 100 are designed to read whatever information may be encoded on the identification badge (for example, the size of the brief on the fixture).

Lower clamp arm 330 is pivotally attached to lower platform 304 at pivot 330*a* and is biased against platform 304 by spring 330*b*. Upper clamp arm 340 is pivotally attached to upper platform 306 at pivot 340*a* and is biased against upper platform 306 by spring 340*b*.

Gripping arms 360, generally denoted, are supported by upper support 312. Gripper supports 380 are rigidly affixed to and extend outwardly from supports 312. Gripper sub-frames 378 are pivotally connected to gripper supports 380 at pivots 376 and are held in place by detent systems 377.

Pushing pivot rod 376 forward will cause detent system 377 to disengage, allowing gripper sub-frames 378 to rotate downwardly. Mounted on gripper sub-frames 378 are lower gripper arms 362 and upper gripper arms 364. Linkages 366 are connected to lower gripper arms 362 at pivots 368 and to the control rods 374 such that when rods 374 are rotated, linkages 366 draw lower gripper arms 362 downward. Guides 370 maintain the attitude of lower gripper arms 362 throughout the range of motion. Springs 370*b* bias lower gripper arms 362 upward against upper gripper arms 364.

Upper clamp arm 340 may be raised by applying a downward force to pivot end 340*c*. Similarly, lower clamp arm 330 may be raised by applying an upward force to pivot end 330*c*.

Fixture 300 may be used as follows to receive and secure two pieces of fabric in order to construct a garment such as a pair of men's briefs.

An external actuator engages pins 375 and pushes pivot rods 376 forward causing detent systems 377 to disengage, thereby allowing gripper sub-frames 378 to be rotated downward. After gripper sub-frames 378 are rotated, then lower and upper gripper arms 362 and 364 are separated by rotating control rod 374. Gripper arms 362 and 364 are now positioned to receive fabric hanging vertically. An external apparatus can be used to insert the fabric. Control rods 374 are then released, allowing gripper arms 362,364 to close so that now the two ends of the fabric are held by the gripper arms. The gripper sub-frames 378 are then rotated upward about pivot 376. The ends of the fabric are now held horizontally by the gripper arms, which is the preferred position for sewing and trimming operations.

Simultaneous with the opening of the gripper arms, lower clamp arms 330 and upper clamp arms 340 are raised by pressing pivot ends 330*c* and 340*c*, respectively. The front fabric panel is then inserted between upper clamp arm 340 and upper platform 306. The pivot end 340C is then released, allowing upper clamp arm 340 to pin down the front panel. Likewise, the center portion of the back panel is inserted between lower clamp arm 340 and lower platform 304 along with being inserted into the openings of gripper arms 362, 364. Pivot end 330C is then released and the back panel is secured by lower clamp arm 330 and lower platform 304.

Once mounted in the fixture as described above and shown in FIG. 6, the panels are in the preferred position. All of the critical edges of fabric are accurately located, firmly secured, and held such that they can be easily accessed and manipulated.

A further benefit of fixture 300's design is that it facilitates use of a transfer station, generally denoted as 400, which forms a part of the present invention. The basic purpose of the transfer station is to remove a combined front and back panel from fixture 300 and hold the fabric such that it can be subsequently operated on.

Transfer station 400 has a rotatable mast 402. Mast 402 is mounted by rotational pivot 406 onto base 407, which is in turn fixedly mounted onto table 409. Rotator motor 411 is operatively connected to turn mast 402. Lift assemblies, denoted generally 410, are mounted on mast 402 by braces 404. Braces 404 are vertically slidable along tracks 401 formed in mast 402.

Lift assemblies 410 have carriages 412 formed thereon. Eight clamp arms 414 depend from each of carriages 412 in four sets of opposed pairs. Each clamp arm 414 has foam backing 414A located on the surface facing its opposing clamp arm 414. Clamp arm actuator means 416 mounted on carriages 412 are operatively connected to clamp arms 412 and are designed to move the same between an open position and a closed position. In the closed position, the foam backing 414A on each clamp arm 414 is pressed against the foam backing of the opposing clamp arm 414. In the open position, the clamp arms are separated.

A pivot assembly, generally denoted 460, has platform 462, which is securely mounted on 409. Pivot point 464 is slidably mounted on platform 462 and pivotly holds base 470. Support 472 extends upwardly from base 470 and supports engagement rods 466, upper release actuator 467, lower release actuator 469, fixture latch 474 and actuator rods 468. Engagement rods 466 are designed to be inserted into the transfer engagement bushings 314 of combining fixture 300 and are adequately sturdy to lift the fixture. Actuator rods 468 are designed to engage the ends of control rods 374 and rotate the same, such that gripper arms 362 and 364 are opened and closed. Upper and lower release actuators 467 and 469 are designed to engage the ends 340C,330C of upper and lower clamp arms 340 and ,330 and fixture latch 474 to secure the fixture during rotation.

Figure 5:
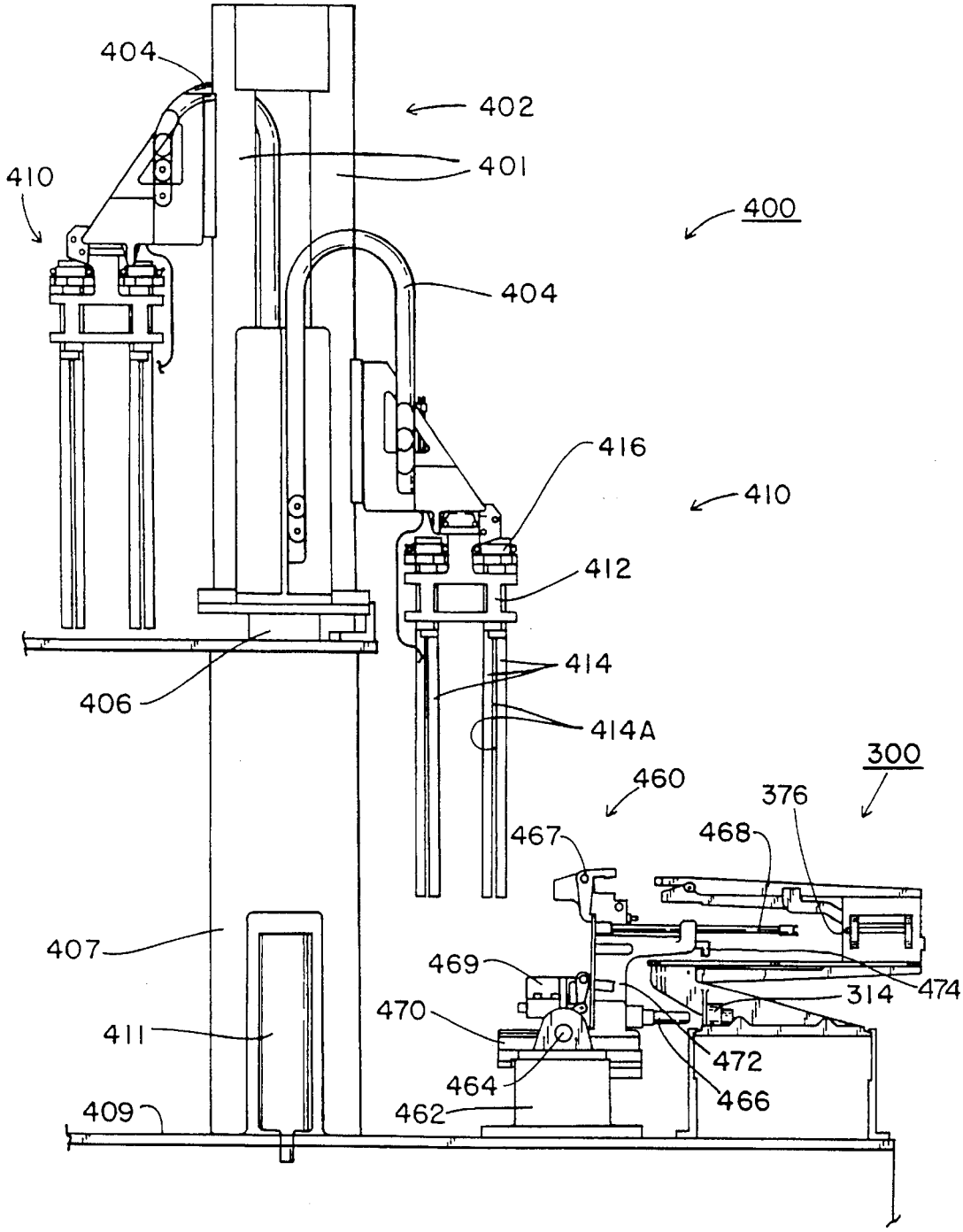
FIG. 5 is a side elevational view of a transfer station which forms a part of the present invention.
Figure 6:
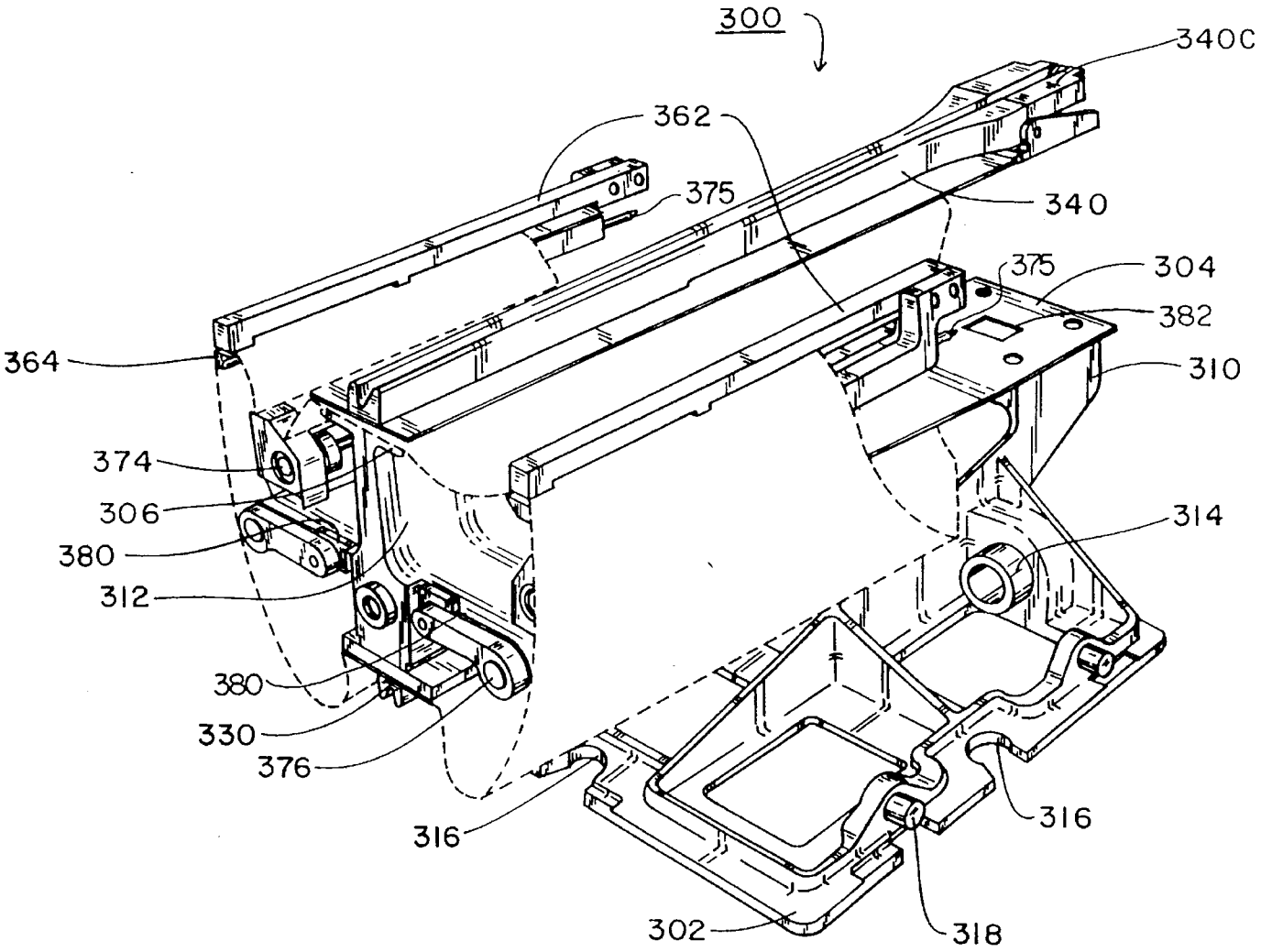
FIG. 6 is a perspective view of the combining fixture of the present invention with a brief, shown in dotted line form.

A fabric brief (combined front and back panels) is transferred from combining fixture 300 to clamp arms 414 as follows. Conveyor 100 positions and raises fixture 300 in front of pivot assembly 460, as shown in FIG. 5. Pivot point 464 and base 470 slide forward so that pivot assembly 460 engages fixture 300. As pivot assembly 460 engages fixture 300, actuator rod 468 engages control rods 374 and engagement rods 466 enter transfer engagement bushings 314 and fixture latch 474 engages slot 382. Fixture 300 is then lifted to a vertical position by pivoting base 470 at pivot point 464.

Once fixture 300 is in the vertical position, retracted carriage 412 is lowered such that the clamp arms 414, which are in the open position, surround the brief. Carriage 412 then extends. Clamp arms 414 are now positioned such that each pair of opposed clamp arms has one clamp arm on the exterior circumference of the brief and one clamp arm on the interior circumference of the brief. The clamp arms are then put in the closed position by actuator means 416, so that each of the four sets of the clamp arms 414 is gripping the brief on a separate point along its circumference and fully along its length. Actuator rod 468, still engaged with control rods 374, is rotated, opening gripper arms 362 and 364 of fixture 300. Simultaneously, upper release actuator 467 is operated to press downwardly on upper pivot end 340C to raise upper clamp arm 340, and lower release actuator 469 is operated to press upwardly upon lower pivot end 330C to lower clamp arm 330. As a result of these operations, the brief which is now securely held by clamp arm 414, is released from fixture 300.

Lift assembly 410 is then raised vertically by powering brace 404 up track 401. Finally, lift assembly 410 and the brief it is holding are transferred to the opposite side of mast 402 by rotating mast 402 at rotational pivot 406. The brief can now be transferred to another apparatus for further operations or placed in a bin for shipping.

After the brief has been removed from fixture 300, fixture 300 is lowered back onto conveyor 100 by reversing the lifting steps.

Certain modifications and improvements will occur to those skilled in the art upon a reading of the foregoing disclosure. It should be understood that all such modifications and improvements have been deleted herein for the sake of conciseness and readability, but are properly in the scope of the following claims.

We claim:

1. A combining conveyor system for combining a first fabric piece and a second fabric piece to form a combined fabric piece, said system comprising:

(a) a combining fixture having means for holding said first fabric piece and said second fabric piece;

(b) a conveyor for transporting said combining fixture;

(c) at least one work station having means for combining said first and second fabric pieces; and (d) a transfer station for removing said combining fixture from said conveyor, wherein said transfer station includes; (i) engaging means for engaging said combining fixture; (ii) a tilt actuator for selectively moving said engaging means; and (iii) means for removing said combined fabric piece from said combining fixture.

2. The combining conveyor system claim 1 wherein said engaging means for engaging said combining fixture includes one or more rods and one or more holes adapted to receive said rods.

3. The combining conveyor system of claim 2 wherein said tilt actuator is operative to selectively move said engaging means, and thereby said fixture when the same is engaged with said engaging means, between a first position and a second position.

4. The combining conveyor system of claim 3 wherein the angle between said first position and said second position is about 90°.

5. The combining conveyor system of claim 1 wherein said means for removing said combined fabric piece includes a plurality of clamps and a clamp actuator.

6. The combining conveyor system of claim 5 wherein said plurality of clamps and said clamp actuator are selectively moveable between a first unclamped position and a second clamped position.

7. The combining conveyor system of claim 1 wherein said combining conveyor includes:

(a) a support frame;

(b) at least one belt; and (c) drive means for driving said belt.

8. The combining conveyor system of claim 7 wherein said support frame is generally rectangular having four adjacent legs.

9. The combining conveyor system of claim 8 further including transfer means for transferring said combining fixture from one leg of said rectangular support frame to an adjacent leg of said rectangular support frame.

10. The combining conveyor system of claim 9 wherein said transfer means includes:

(a) a lift for lifting said combining fixture;

(b) at least one belt; and (c) drive means for driving said belt.

11. The combining conveyor system of claim 7 wherein said belts include a primary belt for transporting said combining fixture at one speed and a secondary belt for transporting said combining fixture at a different speed.

12. The combining conveyor system of claim 11 further including a lift to lift said secondary belt above said primary belt such that said combining fixture is supported and transported by said secondary belt.

13. The combining conveyor system of claim 1 wherein one of said work stations is a sewing machine for sewing together said first fabric piece and said second fabric piece to form said combined fabric piece.

14. A combining fixture for combining a first fabric piece and a second fabric piece to form a combined fabric piece, said fixture comprising:

(a) a base;

(b) fabric clamping means for receiving and securing said first fabric piece, wherein said fabric clamping means includes: (i) a support; (ii) a control arm clamp attached to said support; and (iii) at least one gripping arm, said second fabric piece, and said combined fabric piece formed from said first and second fabric pieces;

(c) a support attached to said base and supporting said fabric clamping means; and (d) an identification means including an encoded badge located on said combining fixture.

15. The combining fixture of claim 14 wherein said base is square shaped.

16. The combining fixture of claim 14 wherein said combining fixture further includes sensor means for determining the relative position of said combining fixture to said conveyor.

17. The combining fixture of claim 14 wherein said combining fixture further includes bumper means.

18. The combining fixture of claim 14 wherein said control arm clamp is a cantilever.

19. The combining fixture of claim 18 wherein said cantilever control arm clamp is a biased member.

20. The combining fixture of claim 19 wherein said cantilever control arm clamp is a spring biased member.

21. The combining fixture of claim 14 wherein said gripping arm is selectively moveable between a first horizontal position and a second vertical position.

22. The combining fixture of claim 14 wherein said gripping arm has at least one set of parallel clamps for receiving and securing said first fabric piece, said second fabric piece, or said combined fabric piece.

23. The combining fixture of claim 22 wherein said parallel clamps are biased to a closed position.

24. The combining fixture of claim 23 wherein said parallel clamps are spring biased to a closed position.

25. The combining fixture of claim 14 wherein said support includes a cantilever arm which extends back over said base.

26. The combining fixture of claim 14 wherein said clamping means are selectively moveable between a first receiving position and a second securing position and include means for operatively engaging an actuating means for manipulating said fabric clamping means between said first receiving position and said second securing position.

27. A combining conveyor system for combining a first fabric piece and a second fabric piece to form a combined fabric piece, said system comprising:

(a) a combining fixture, said fixture including: (i) a base; (ii) fabric clamping means for receiving and securing said first fabric piece, said second fabric piece, and said combined fabric piece formed from said first and second fabric pieces; and (iii) a support attached to said base and supporting said fabric clamping means;

(b) a conveyor for transporting said combining fixture;

(c) at least one work station having means for combining said first and second fabric pieces; and (d) a transfer station for removing said combining fixture from said conveyor, wherein said transfer station includes: (i) engaging means for engaging said combining fixture; (ii) a tilt actuator for selectively moving said engaging means; and (iii) means for removing said combined fabric piece from said combining fixture.

28. The combining conveyor system of claim 27 wherein said engaging means for engaging said combining fixture includes one or more rods and one or more holes adapted to receive said rods.

29. The combining conveyor system of claim 28 wherein said tilt actuator is operative to selectively move said engaging means, and thereby said fixture when the same is engaged with said engaging means, between a first position and a second position.

30. The combining conveyor system of claim 29 wherein the angle between said first position and said second position is about 90°.

31. The combining conveyor system of claim 27 wherein said means for removing said combined fabric piece includes a plurality of clamps and a clamp actuator.

32. The combining conveyor system of claim 31 wherein said plurality of clamps and said clamp actuator are selectively moveable between a first unclamped position and a second clamped position.

33. The combining conveyor system of claim 27 wherein said combining conveyor includes:

(a) a support frame;

(b) at least one belt; and (c) drive means for driving said belt.

34. The combining conveyor system of claim 33 wherein said support frame is generally rectangular having four adjacent legs.

35. The combining conveyor system of claim 34 further including transfer means for transferring said combining fixture from one leg of said rectangular support frame to an adjacent leg of said rectangular support frame.

36. The combining conveyor system of claim 35 wherein said transfer means includes:

(a) a lift for lifting said combining fixture;

(b) at least one belt; and (c) drive means for driving said belt.

37. The combining conveyor system of claim 33 wherein said belts include a primary belt for transporting said combining fixture at one speed and a secondary belt for transporting said combining fixture at a different speed.

38. The combining conveyor system of claim 37 further including a lift to lift said secondary belt above said primary belt such that said combining fixture is supported and transported by said secondary belt.

39. The combining conveyor system of claim 27 wherein one of said work stations is a sewing machine for sewing together said first fabric piece and said second fabric piece to form said combined fabric piece.

40. The combining conveyor system of claim 27 wherein said base is square shaped.

41. The combining conveyor system of claim 27 wherein said combining fixture further includes sensor means for determining the relative position of said combining fixture to said conveyor.

42. The combining conveyor system of claim 27 said combining fixture further includes bumper means.

43. The combining conveyor system of claim 27 wherein said combining fixture further includes identification means.

44. The combining conveyor system of claim 45 wherein said identification means includes an encoded badge located on said combining fixture, and wherein said combining conveying system further includes a scanning device for receiving messages from said encoded badge.

45. The combining conveyor system of claim 27 wherein said fabric clamping means includes:

(a) a support;

(b) a control arm clamp attached to said support; and (c) at least one gripping arm.

46. The combining conveyor system of claim 45 wherein said control arm clamp is a cantilever.

47. The combining conveyor system of claim 46 wherein said cantilever control arm clamp is a biased member.

48. The combining conveyor system of claim 47 wherein said cantilever control arm clamp is a spring biased member.

49. The combining conveyor system of claim 45 wherein said gripping arm is selectively moveable between a first horizontal position and a second vertical position.

50. The combining conveyor system of claim 45 wherein said gripping arm has at least one set of parallel clamps for receiving and securing said first fabric piece, said second fabric piece, or said combined fabric piece.

51. The combining conveyor system of claim 50 wherein said parallel clamps are biased to a closed position.

52. The combining conveyor system of claim 51 wherein said parallel clamps are spring biased to closed position.

53. The combining conveyor system of claim 27 wherein said support includes a cantilever arm which extends back over said base.

54. The combining conveyor system of claim 27 wherein said clamping means are selectively moveable between a first receiving position and a second securing position and include means for operatively engaging an actuating means for manipulating said fabric clamping means between said first receiving position and said second securing position.

55. A combining conveyor system for combining a first fabric piece and a second fabric piece to form a combined fabric piece, said system comprising:

(a) a combining fixture having means for holding said first fabric piece and said second fabric piece;

(b) a conveyor for transporting said combining fixture; and (c) at least one work station having means for combining said first and second fabric pieces, wherein one of said at least one work station is a sewing machine for sewing together said first fabric piece and said second fabric piece to form said combined fabric piece, wherein said combining conveyor includes: (i) a support frame; (ii) at least one belt; and (iii) drive means for driving said belt, wherein said support frame is generally rectangular having four adjacent legs and further including transfer means for transferring said combining fixture from one leg of said rectangular support frame to an adjacent leg of said rectangular support frame, wherein said transfer means includes: a primary belt; a secondary belt; drive means for driving said primary belt and secondary belt; and a lift to lift said secondary belt above said primary belt such that said combining fixture is supported and transported by said secondary belt.

56. The combining conveyor system of claim 55 further including a transfer station for removing said combining fixture from said conveyor.

57. The combining conveyor system of claim 56 wherein said transfer station includes:

(a) engaging means for engaging said combining fixture;

(b) a tilt actuator for selectively moving said engaging means; and (c) means for removing said combined fabric piece from said combining fixture.

58. The combining conveyor system of claim 57 wherein said engaging means for engaging said combining fixture includes one or more rods and one or more holes adapted to receive said rods.

59. The combining conveyor system of claim 58 wherein said tilt actuator is operative to selectively move said engaging means, and thereby said fixture when the same is engaged with said engaging means, between a first position and a second position.

60. The combining conveyor system of claim 59 wherein the angle between said first position and said second position is about 90°.

61. The combining conveyor system of claim 59 wherein said means for removing said combined fabric piece includes a plurality of clamps and a clamp actuator.

62. The combining conveyor system of claim 61 wherein said plurality of clamps and said clamp actuator are selectively moveable between a first unclamped position and a second clamped position.

63. The combining conveyor system of claim 55 wherein said primary belt transports said combining fixture at one speed and said secondary belt transports said combining fixture at a different speed.

64. A combining conveyor system for combining a first fabric piece and a second fabric piece to form a combined fabric piece, said system comprising:

(a) a combining fixture having means for holding said first fabric piece and said second fabric piece;

(b) a conveyor for transporting said combining fixture; and (c) at least one work station having means for combining said first and second fabric pieces, wherein said combining conveyor includes: (i) a support frame; (ii) at least one belt; and (iii) drive means for driving said belt, wherein said belts include a primary belt for transporting said combining fixture at one speed and a secondary belt for transporting said combining fixture at a different speed.

65. The combining conveyor system of claim 64 further including a transfer station for removing said combining fixture from said conveyor.

66. The combining conveyor system of claim 65 wherein said transfer station includes:

(a) engaging means for engaging said combining fixture;

(b) a tilt actuator for selectively moving said engaging means; and (c) means for removing said combined fabric piece from said combining fixture.

67. The combining conveyor system of claim 66 wherein said engaging means for engaging said combining fixture includes one or more rods and one or more holes adapted to receive said rods.

68. The combining conveyor system of claim 67 wherein said tilt actuator is operative to selectively move said engaging means, and thereby said fixture when the same is engaged with said engaging means, between a first position and a second position.

69. The combining conveyor system of claim 68 wherein the angle between said first position and said second position is about 90°.

70. The combining conveyor system of claim 67 wherein said means for removing said combined fabric piece includes a plurality of clamps and a clamp actuator.

71. The combining conveyor system of claim 70 wherein said plurality of clamps and said clamp actuator are selectively moveable between a first unclamped position and a second clamped position.

72. The combining conveyor system of claim 64 wherein said support frame is generally rectangular having four adjacent legs.

73. The combining conveyor system of claim 72 further including transfer means for transferring said combining fixture from one leg of said rectangular support frame to an adjacent leg of said rectangular support frame.

74. The combining conveyor system of claim 73 wherein said transfer means includes:

(a) a lift for lifting said combining fixture;

(b) at least one belt; and (c) drive means for driving said belt.

75. The combining conveyor system of claim 64 further including a lift to lift said secondary belt above said primary belt such that said combining fixture is supported and transported by said secondary belt.

76. The combining conveyor system of claim 64 wherein one of said work stations is a sewing machine for sewing together said first fabric piece and said second fabric piece to form said combined fabric piece.

77. A combining conveyor system for combining a first fabric piece and a second fabric piece to form a combined fabric piece, said system comprising:

(a) a combining fixture, said fixture including: (i) a base; (ii) fabric clamping means for receiving and securing said first fabric piece, said second fabric piece, and said combined fabric piece formed from said first and second fabric pieces; and (iii) a support attached to said base and supporting said fabric clamping means;

(b) a conveyor for transporting said combining fixture, wherein said combining conveyor includes: (i) a support frame; (ii) at least one belt; and (iii) drive means for driving said belt, wherein said support frame is generally rectangular having four adjacent legs and further including transfer means for transferring said combining fixture from one leg of said rectangular support frame to an adjacent leg of said rectangular support frame;

(c) at least one work station having means for combining said first and second fabric pieces; and (d) a transfer station for removing said combining fixture from said conveyor.

78. The combining conveyor system of claim 77 wherein said transfer station includes:

(a) engaging means for engaging said combining fixture;

(b) a tilt actuator for selectively moving said engaging means; and (c) means for removing said combined fabric piece from said combining fixture.

79. The combining conveyor system of claim 78 wherein said engaging means for engaging said combining fixture includes one or more rods and one or more holes adapted to receive said rods.

80. The combining conveyor system of claim 79 wherein said tilt actuator is operative to selectively move said engaging means, and thereby said fixture when the same is engaged with said enraging means, between a first position and a second position.

81. The combining conveyor system of claim 80 wherein the angle between said first position and said second position is about 90°.

82. The combining conveyor system of claim 78 wherein said means for removing said combined fabric piece includes a plurality of clamps and a clamp actuator.

83. The combining conveyor system of claim 82 wherein said plurality of clamps and said clamp actuator are selectively moveable between a first unclamped position and a second clamped position.

84. The combining conveyor system of claim 77 wherein said transfer means includes:

(a) a lift for lifting said combining fixture;

(b) at least one belt; and (c) drive means for driving said belt.

85. The combining conveyor system of claim 77 wherein said belts include a primary belt for transporting said combining fixture at one speed and a secondary belt for transporting said combining fixture at a different speed.

86. The combining conveyor system of claim 85 further including a lift to lift said secondary belt above said primary belt such that said combining fixture is supported and transported by said secondary belt.

87. The combining conveyor system of claim 77 wherein one of said work stations is a sewing machine for sewing together said first fabric piece and said second fabric piece to form said combined fabric piece.

88. The combining conveyor system of claim 77 wherein said base is square shaped.

89. The combining conveyor system of claim 77 wherein said combining fixture further includes sensor means for determining the relative position of said combining fixture to said conveyor.

90. The combining conveyor system of claim 77 wherein said combining fixture further includes bumper means.

91. The combining conveyor system of claim 77 wherein said combining fixture further includes identification means.

92. The combining conveyor system of claim 91 wherein said identification means includes an encoded badge located on said combining fixture, and wherein said combining conveying system further includes a scanning device for receiving messages from said encoded badge.

93. The combining conveyor system of claim 77 wherein said fabric clamping means includes:

(a) a support;

(b) a control arm clamp attached to said support; and (c) at least one gripping arm.

94. The combining conveyor system of claim 93 wherein said control arm clamp is a cantilever.

95. The combining conveyor system of claim 94 wherein said cantilever control arm clamp is a biased member.

96. The combining conveyor system of claim 95 wherein said cantilever control arm clamp is a spring biased member.

97. The combining conveyor system of claim 93 wherein said gripping arm is selectively moveable between a first horizontal position and a second vertical position.

98. The combining conveyor system of claim 93 wherein said gripping arm has at least one set of parallel clamps for receiving and securing said first fabric piece, said second fabric piece, or said combined fabric piece.

99. The combining conveyor system of claim 98 wherein said parallel clamps are biased to a closed position.

100. The combining conveyor system of claim 99 wherein said parallel clamps are spring biased to a closed position.

101. The combining conveyor system of claim 77 wherein said support includes a cantilever arm which extends back over said base.

102. The combining conveyor system of claim 77 wherein said clamping means are selectively moveable between a first receiving position and a second securing position and include means for operatively engaging an actuating means for manipulating said fabric clamping means between said first receiving position and said second securing position.

* * * * *